US007357405B2

(12) United States Patent
Leitner

(10) Patent No.: US 7,357,405 B2
(45) Date of Patent: Apr. 15, 2008

(54) SLIDING BOARD, IN PARTICULAR ALPINE SKI OR SNOWBOARD

(75) Inventor: Wolfgang Leitner, Uttendorf (AT)

(73) Assignee: Blizzard Sport GmbH, Mittersill (AT)

( * ) Notice: Subject to any disclaimer, the term of this patent is extended or adjusted under 35 U.S.C. 154(b) by 101 days.

(21) Appl. No.: 11/191,347

(22) Filed: Jul. 28, 2005

(65) Prior Publication Data

US 2006/0131838 A1 Jun. 22, 2006

(30) Foreign Application Priority Data

Dec. 21, 2004 (DE) ..... 20 2004 019 710 U

(51) Int. Cl.
*A63C 9/00* (2006.01)

(52) U.S. Cl. ..... 280/601; 280/607; 280/609; 280/11.36; 280/618; 280/600; 280/619; 280/809; 280/14.21; 280/815; 280/633

(58) Field of Classification Search ..... 280/601, 280/11.12, 841, 607, 609, 11.36, 618, 600, 280/619, 809, 634, 14.21, 815, 633
See application file for complete search history.

(56) References Cited

U.S. PATENT DOCUMENTS

| | | | | |
|---|---|---|---|---|
| 4,058,326 | A * | 11/1977 | Faulin | 280/617 |
| 4,969,655 | A | 11/1990 | Katz | |
| 5,199,734 | A * | 4/1993 | Mayr | 280/602 |
| 5,575,496 | A * | 11/1996 | Luitz et al. | 280/618 |
| 5,664,901 | A * | 9/1997 | Mayr | 403/297 |
| 5,787,612 | A * | 8/1998 | Mahoney et al. | 36/124 |
| 6,308,978 | B1 * | 10/2001 | Kelman | 280/608 |
| 6,412,807 | B1 * | 7/2002 | Arduin et al. | 280/607 |
| 6,557,866 | B2 * | 5/2003 | Jones et al. | 280/14.22 |
| 6,595,541 | B2 * | 7/2003 | Kuchler | 280/601 |
| 6,641,162 | B2 * | 11/2003 | Allmann et al. | 280/607 |
| 6,923,464 | B2 * | 8/2005 | Noviant | 280/607 |
| 7,021,648 | B2 * | 4/2006 | Deborde et al. | 280/607 |
| 2007/0205583 | A1 * | 9/2007 | Schary et al. | 280/609 |

FOREIGN PATENT DOCUMENTS

| | | | |
|---|---|---|---|
| DE | 696 06 577 | T2 | 10/2000 |
| EP | 1 161 972 | A2 | 12/2001 |
| EP | 1 161 972 | A3 | 12/2001 |
| EP | 1 366 785 | A1 | 3/2003 |
| EP | 1 559 453 | A1 | 3/2005 |
| FR | 2761273 | A | 1/1998 |
| WO | WO 02/49728 | A1 | 6/2002 |
| WO | WO 03/039687 | A2 | 3/2003 |
| WO | WO 2004/078283 | A1 | 9/2004 |
| WO | WO 2004/078286 | A1 | 9/2004 |

OTHER PUBLICATIONS

European Search Report, Sep. 12, 2005.

* cited by examiner

*Primary Examiner*—Christopher P. Ellis
*Assistant Examiner*—Cynthia F. Collado
(74) *Attorney, Agent, or Firm*—Carter DeLuca Farrell & Schmidt LLP

(57) ABSTRACT

The invention relates to a sliding board, in particular alpine ski or snowboard, with a sliding-board basic body and a binding-receiving plate. According to the invention, the binding-receiving plate is integrated as a supporting part in the central region of the sliding-board basic body, in which it is used, by being surrounded positively at the sides by raised regions of the sliding-board basic body.

19 Claims, 9 Drawing Sheets

SLIDING BOARD, IN PARTICULAR ALPINE SKI OR SNOWBOARD

The invention relates to sliding boards, in particular alpine skis or snowboards, according to the precharacterizing clause of Claim 1.

In conventional ski constructions, plate fastening elements are mounted on the ski or only partly integrated. From EP 1 161 972 A, a sliding board, that is a ski or snowboard, with a profiled rail system is known, which consists of at least one rail which extends in the longitudinal direction of the sliding board and is connected to the ski basic body via at least one formed-on dowel or dowel portion. In order to provide a sliding board with a premounted profiled rail system, it is therefore; necessary to carry out fastening and mounting operations on the finished sliding board.

However, subsequently mounted fastening elements always have an additionally stiffening effect on the overall system, which makes itself felt through irregularities in the rigidity distribution of the sliding board.

Free sliding of the binding is in some cases prevented by distortion or excessive friction. The close tolerances required in the coupling to the binding parts cannot be observed with subsequently mounted elements. This results in difficulties in mounting and defective functioning in operation.

It is therefore an object of the invention to eliminate the disadvantages indicated above and to mount the binding receiver on the sliding board without the actual character of the sliding board being spoiled by the subsequent mounting.

This object is achieved by the combination of features of Patent Claim 1. Accordingly, the binding-receiving plate is integrated as a supporting part in the central region of the sliding-board basic body, in which it is to be used, by being surrounded positively at the sides by raised regions of the sliding-board basic body.

According to this solution, the binding-receiving elements are received positively by means of an undercut by means of the raised regions of the sliding-board basic body. To prevent axial displacement, an additional screw or an insertable dowel or another similar securing element can be used. According to the invention, the undercut for positive connection of the binding receiver is integrated constructionally into the design of the sliding-board cross section and consequently into the overall structure. In contrast to conventional laminated constructions built up in layers, complex cross-sectional shapes are used in the solution according to the invention.

The sliding-board cross section is characterized in the region of the sliding-board binding receiver by two raised outer regions and a deepened central part, the lateral raised portions comprising the undercut for guiding the binding, while according to an especially advantageous embodiment the central part is deepened, so that the overall rigidity of the sliding board with the supporting binding-receiving parts is compensated on account of this reduction of the sliding-board cross section in the sliding-board central region and consequently a harmonious rigidity profile is guaranteed over the entire length of the sliding board.

The supporting structure of the sliding board is consequently not arranged in planar webs above the core as in conventional constructions but forms complex geometrical structures.

Further advantageous developments of the invention emerge from the other subclaims.

The arrangement of the actual skin elements in the structures according to the invention of the sliding-board basic body results in considerably higher flexural and torsional strengths. Forces are directed into the sliding board and transmitted to the effective edges. By virtue of the constructional design of the sliding board, assemblies with low flexural strength but high torsional strength can be produced. The torsional strength is increased above all in the region of the raised side elements, which is of decisive importance for the transmission of controlling forces to the front part and rear part of the sliding board.

By virtue of the binding receiver being pushed in and being overlapped by the laterally raised regions of the sliding-board basic body, the whole system is protected from mechanical wear and destruction. The binding with the respective receiving elements can be pushed onto the sliding board either from the front or from the rear and can be secured against axial displacements by means of a central screw for example. The binding-receiving plate can be introduced into the sliding-board basic body in such a way that the deepened area, in which it is located, is closed towards the front and axial displacement of the binding towards the front is consequently prevented. The region can likewise be closed towards the rear.

The receiving part, as part of the binding, has the function of holding the binding and guiding it along the fastening rail. Mounting the binding is thus made easier, and binding parts can be of more simple design.

Interfaces, which cause a delay of the controlling end pulses during skiing, are dispensed with.

The use of new technologies and methods is necessary for manufacturing the sliding board according to the invention. The conventional sandwich compound technology, in which reinforcing materials are arranged in layers around a central core, is only partly applicable for forming such structures.

According to the invention, the sliding-board basic body is manufactured using the injection method or the blow-moulding method. Dedicated reinforcements are formed in both the injection method and the blow-moulding method.

Further features, details and advantages of the invention emerge from the embodiments illustrated in the drawing, in which FIG. 1 shows a diagrammatic cross section through a ski according to a preferred embodiment of the invention with integrated binding receiver;

In the illustrative embodiments shown here, the constructional configuration of the sliding board is explained with reference to the construction of a ski.

Figure 1:
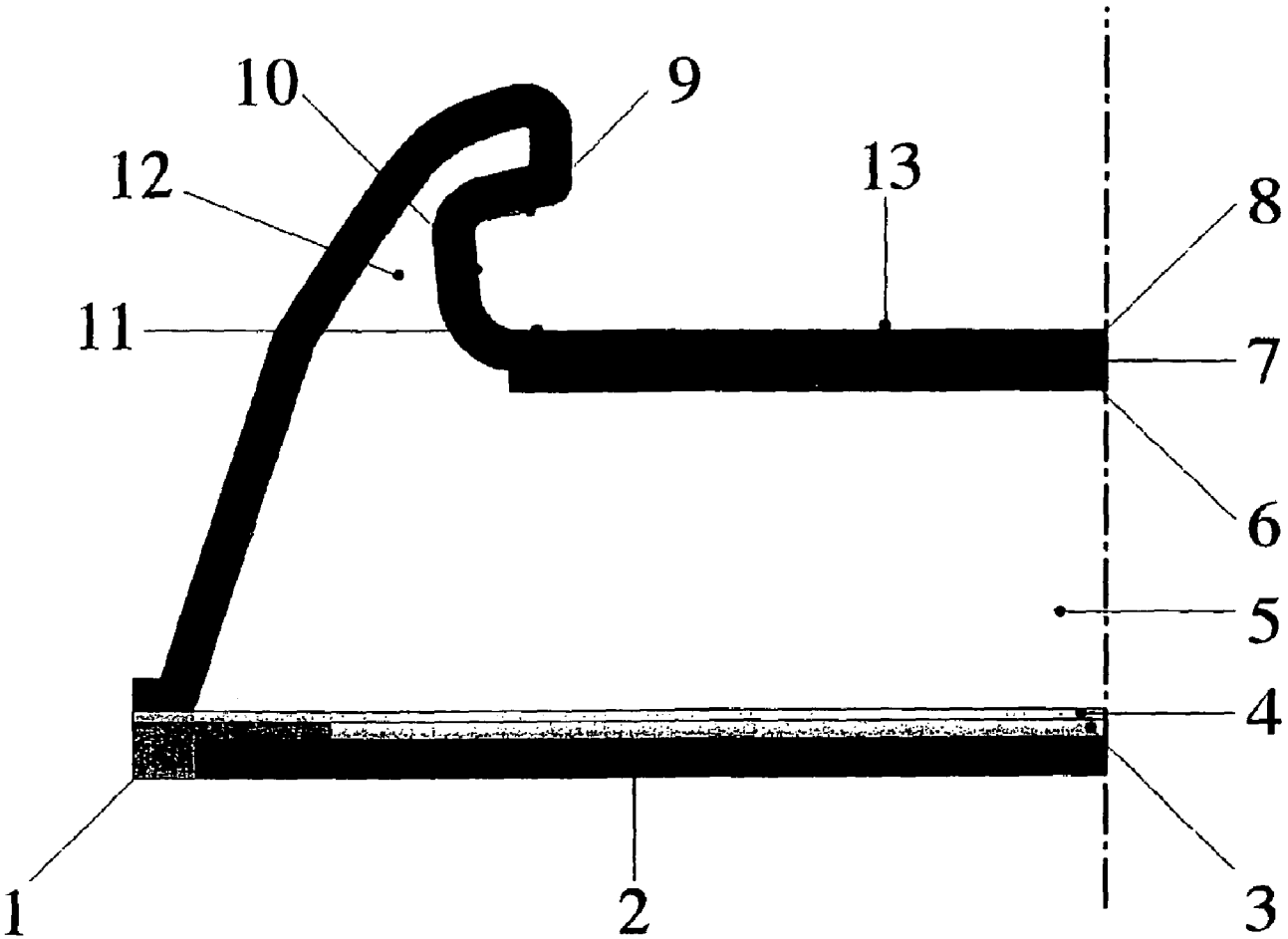

FIG. 1 illustrates a cross-sectional shape with integrated solution according to the present invention. In a known way, the ski has edges 1 and a running surface 2. Provided above the running surface 2 is a narrow lower skin 3, which extends between the edges 1, and above it a wide lower skin 4.

Arranged above the lower skin is the core 5, on which a narrow upper skin 6 and an upper skin 7 in the form of a three-dimensionally shaped shell are arranged. The surface 8 is applied to the upper skin 7. As can be seen from the cross section according to FIG. 1, the ski surface of the ski basic body is designed as a complex three-dimensional structure. A central region 13, on which the binding-receiving region (not illustrated in greater detail in FIG. 1) lies, is formed by the ski basic body, and lateral undercuts are formed, which have an upper contact surface 9, a lateral contact surface 10 and a lower contact surface 11 for receiving a binding-receiving plate (not illustrated in greater detail in FIG. 1). To form this undercut, the upper skin 7 is shaped as a raised lateral region 12.

By virtue of the laterally raised regions 12, the section modulus and, associated with this, the flexural strength and torsional strength are increased considerably in the regions which are relevant for ski performance. The raised lateral regions 12 provide additional overall height, which is desirable, and reduce the size of the ski basic body in the central segment 13 in order to compensate the rigidity distribution and to save weight and material.

Figure 2:
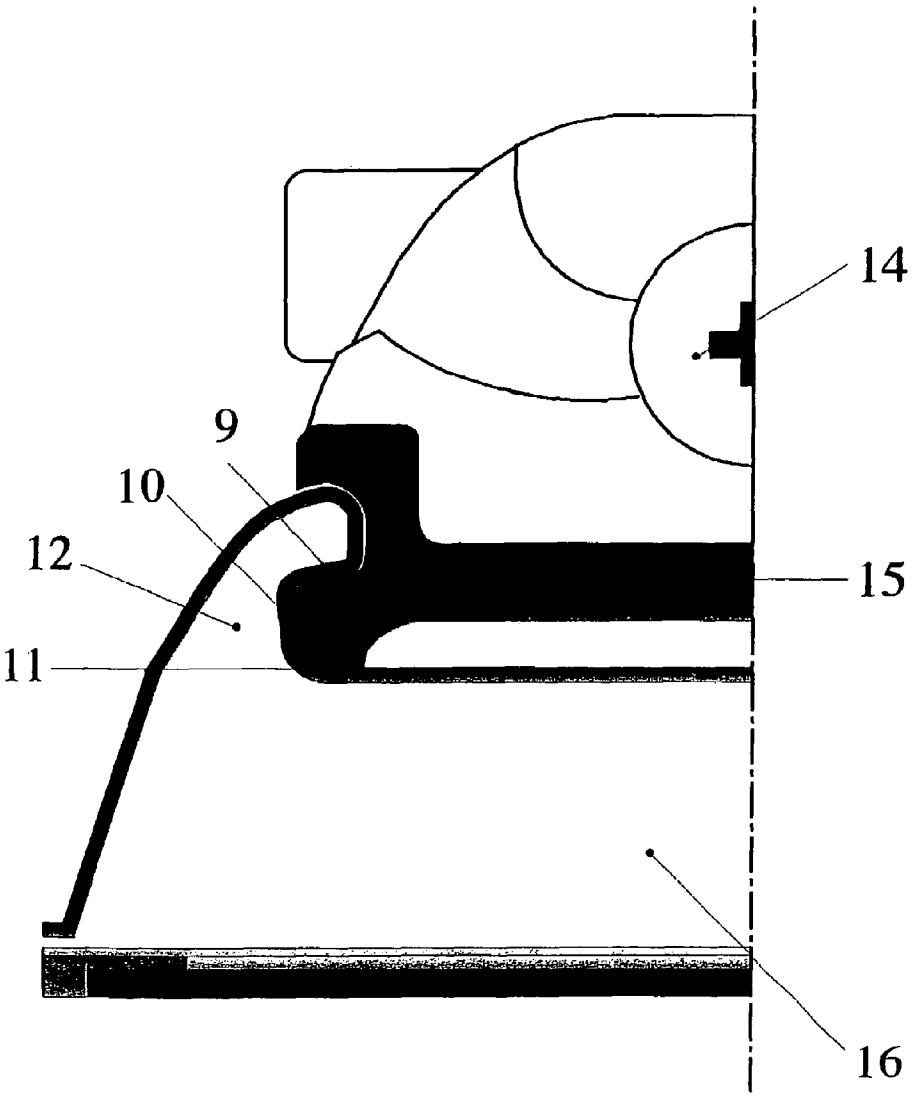
FIG. 2 shows by way of example a ski binding mounted on a ski according to FIG. 1.

FIG. 2 illustrates the attachment of a binding 14 to the ski basic body or ski 16 in cross section. The binding elements 14 are mounted directly on the binding-receiving plate 15. The binding-receiving plate 15 engages positively in the raised lateral regions 12 of the ski basic body and slides on the contact surfaces 9, 10 and 11. By virtue of the special design of the sliding surfaces, virtually friction-free movement of the binding can be guaranteed even during bending of the ski.

Figure 3:
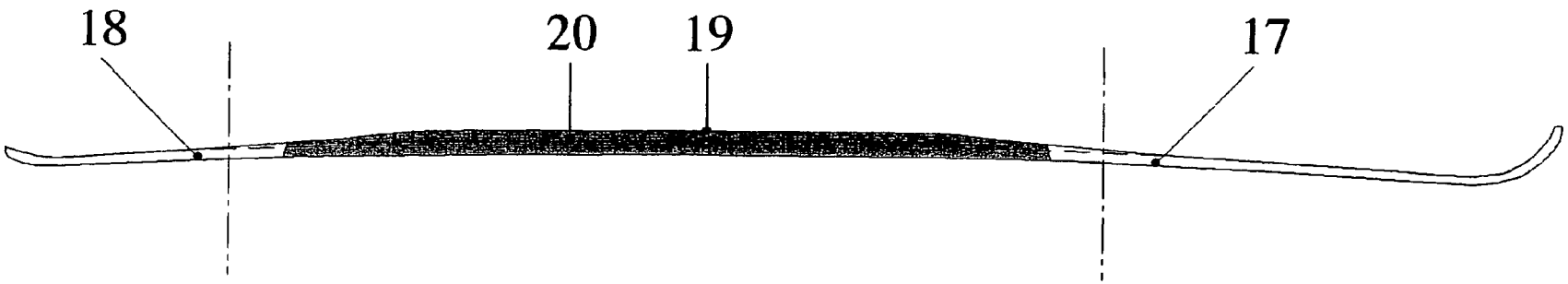
FIG. 3 shows a longitudinal section through a ski according to FIG. 1.

FIG. 3 illustrates a longitudinal section through the ski according to FIG. 1. The tip 17 and the end 18 are illustrated here in the usual way. The cross-sectional illustration shown in FIG. 1 relates to the region 19, that is the central region of the ski, which constitutes the binding fastening part. 20 indicates the undercut, in which the binding-receiving plate 15 is overlapped in the laterally raised regions 12.

Figure 4:
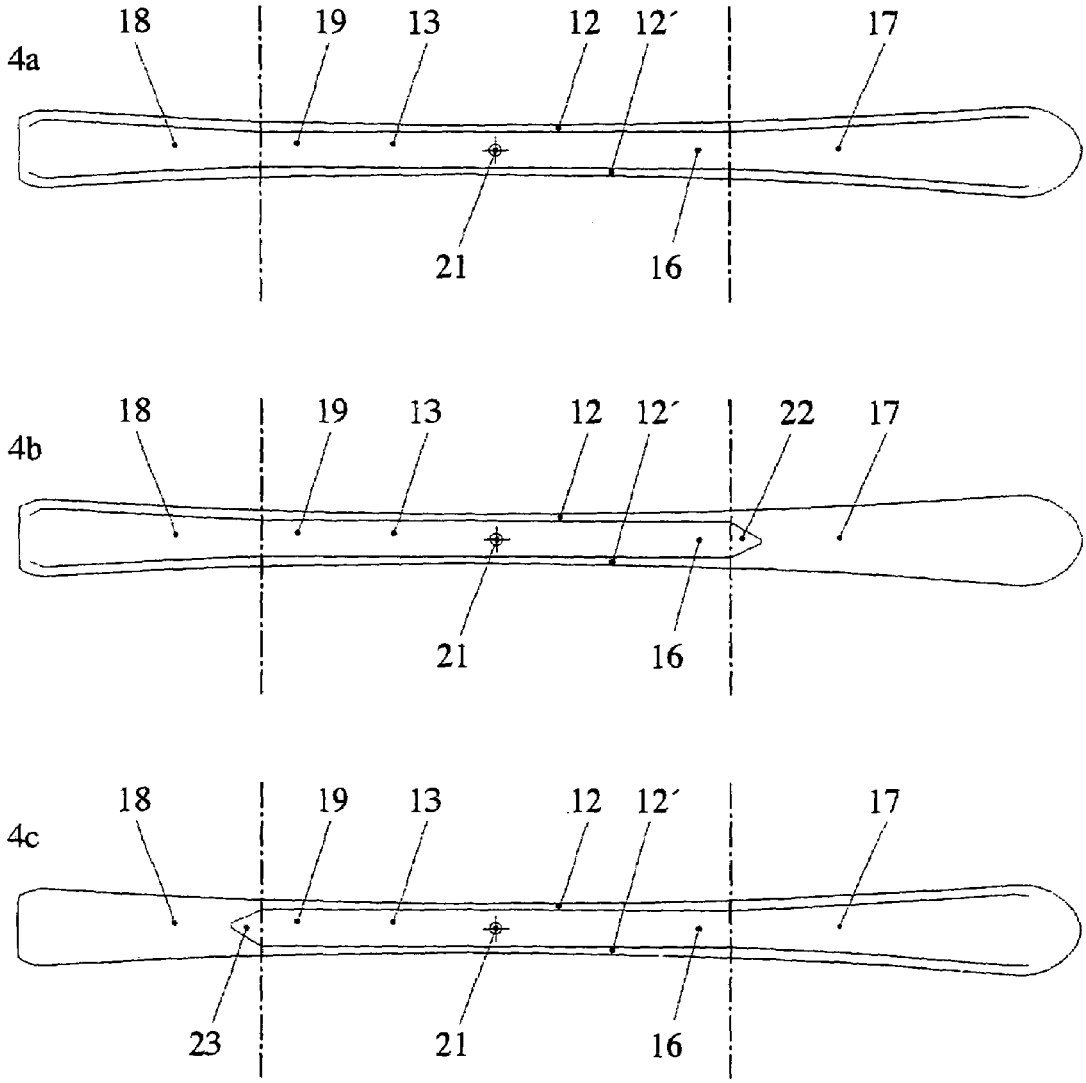
FIG. 4 shows a top view of various types of construction of a ski according to the invention.

FIG. 4 illustrates a top view of the system, different construction types being shown in each of FIGS. 4*a*, 4*b* and 4*c*. The outer contour of the ski corresponds to that of a carving ski. In the case of other sliding boards, it can of course have any other shape. The binding 14 with the binding-receiving plate 15 can be pushed on into the ski basic body 16 either from the front or from the rear and is secured against axial displacements by means of a central screw 21, as illustrated in FIG. 4*a*. Insertion into the undercut region, which is of groove-shaped design, can be arranged in such a way that the deepened area is closed towards the front in the central region 22 and consequently prevents axial displacement of the binding towards the front (cf. FIG. 4*b*). Likewise, the region 23 can be closed towards the rear, and consequently axial displacement of the binding towards the rear can be prevented (FIG. 4*c*).

Figure 5:
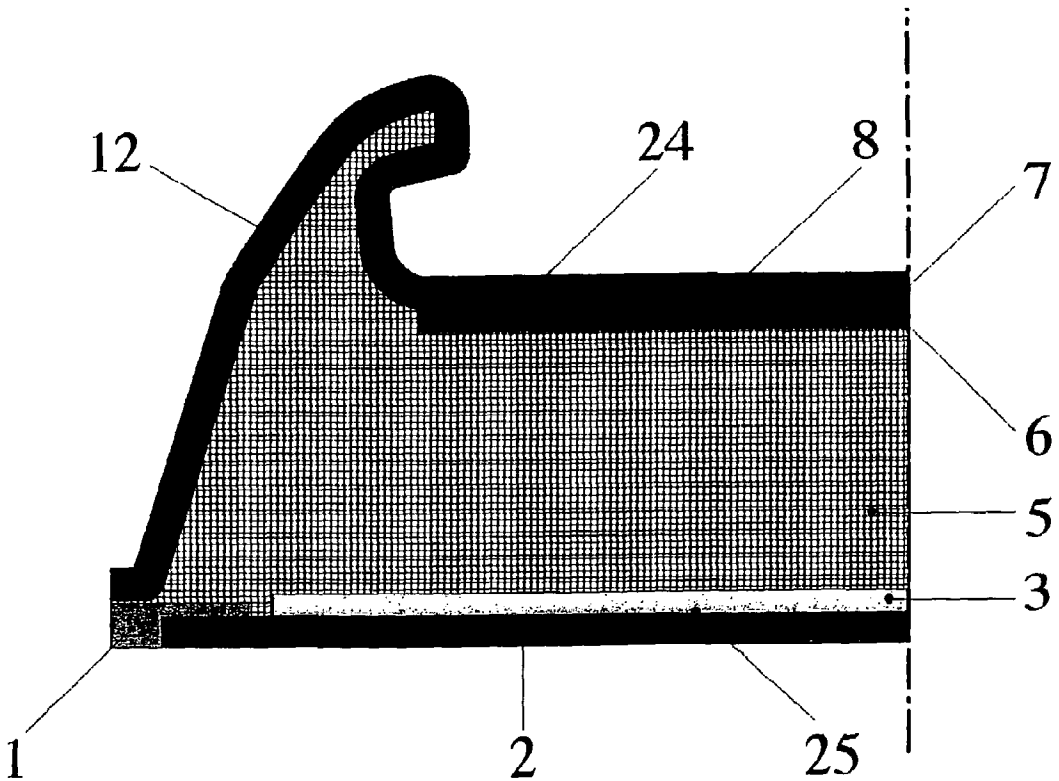
FIG. 5 shows a cross-sectional view similar to that according to FIG. 1 relating to a ski construction according to the present invention with integrated binding receiver, manufactured using the injection method.

FIG. 5 illustrates a ski construction as manufactured using the injection method with an integrated binding receiver. Here, a surface component 24 is formed by an upper skin 6, a shell skin 7 and a surface 8. The running surface component is formed from the running surface 2 and the narrow lower skin 3, while the steel edges 1 are arranged at the sides. The prefabricated surface component 24 and the prefabricated running surface component 25 are foamed by means of PUR high-resistance foam. The reinforcing layer 7 can be formed by either a flexible glass-fibre layer, which is impregnated with PUR during production of the assembly, or a cured prepreg layer, which is applied to the surface in a preceding pressing operation. Likewise, the position of the additional reinforcement 6 can be interchanged with the position of the reinforcement 7.

Figure 6:
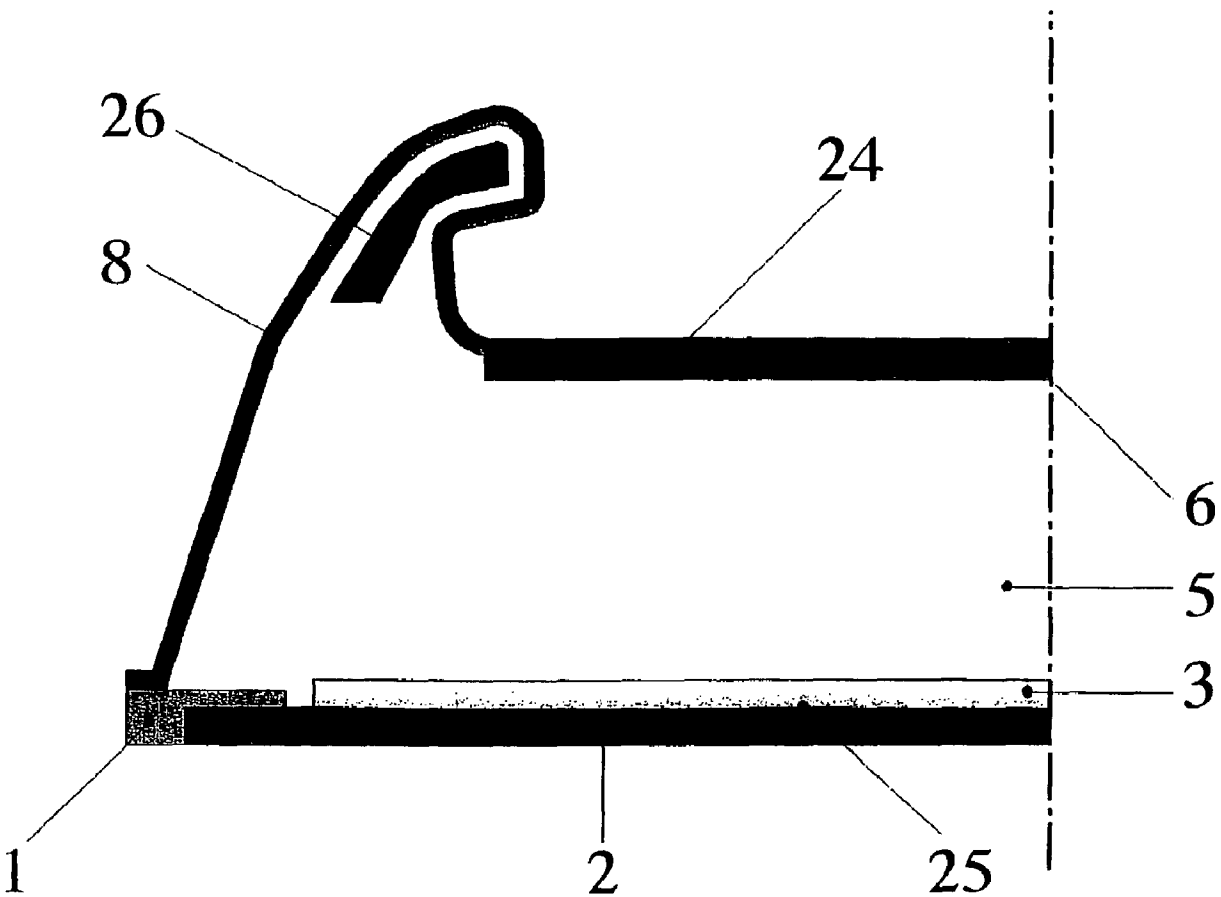
FIG. 6 shows a modified development of the invention in cross section with reinforcement in the binding-receiving regions.

FIG. 6 illustrates the additional reinforcement of the raised lateral regions 12 in cross section. According to this illustration, the upper legs of the raised lateral regions 12 can be reinforced additionally by specific reinforcing materials 26 in order to withstand the forces arising during skiing. Glass-fibre inserts, steel profiles or other profiles can be used as reinforcing elements 26. By virtue of the reinforcement of the legs of the raised lateral regions 12, the upper skin, designated by 7 in the embodiment according to FIG. 1, can be dispensed with.

Figure 7:
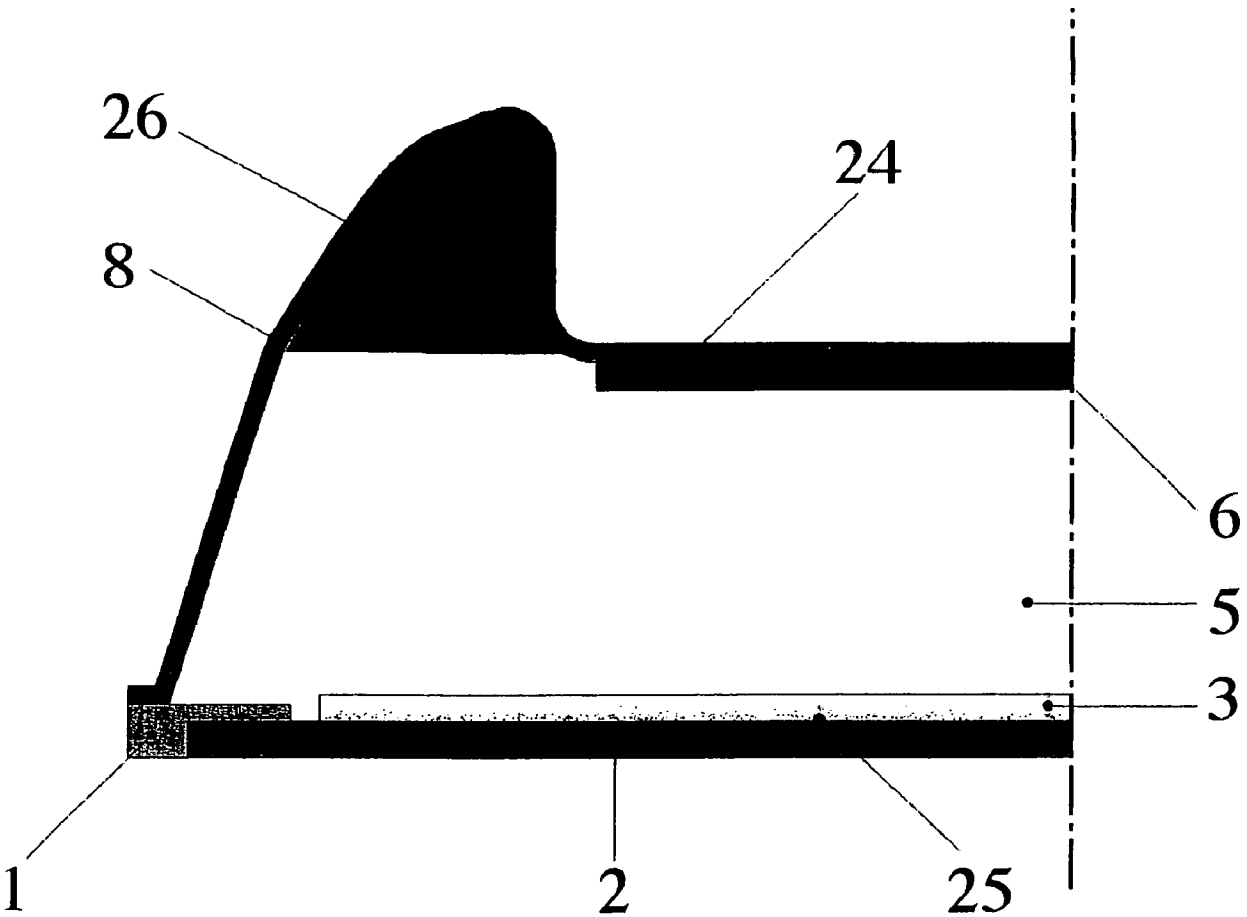
FIG. 7 shows a cross section of an advantageous development of the invention in the guide region with a profiled insert incorporated.

FIG. 7 shows a further solution, in which a profile without undercut is introduced into the lateral regions 12 and the undercut can be produced on the ski, by milling out the lateral regions, only when it is finished. This illustration therefore shows the half-finished ski.

Figure 8:
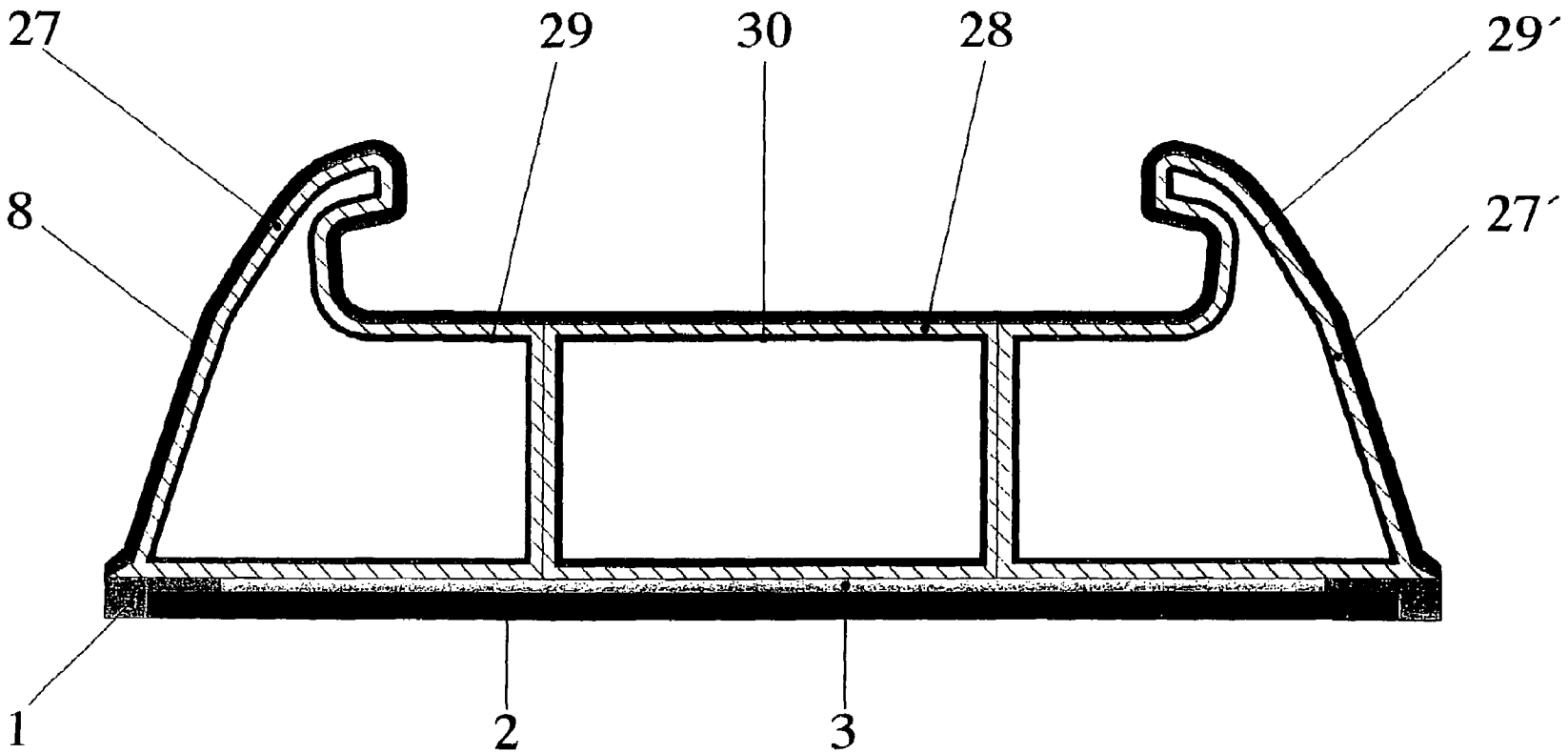
FIG. 8 shows a cross section through a further embodiment of the present invention with integrated binding receiver, manufactured using the blow-moulding method.

FIG. 8 shows a variant embodiment, which has been manufactured using the blow-moulding method. Here, 27 and 27', indicate lateral prepreg hollow bodies and 28 indicates a central prepreg hollow body. 29 and 29' indicate lateral blowing tubes and 30 indicates a central blowing tube.

After fibre-reinforced prepregs 27, 27', 28 have been arranged on a tube 29, 29', 30 and subsequently mounted in a pressing tool, the individual chambers are inflated from inside with positive pressure and, at elevated temperature, pressed against the tool walls and cured. The shaping of the core component can take place either in a mould provided specifically for the purpose or directly during assembly of the ski in the pressing tool. The embodiment shows by way of example a three-part embodiment, in which the two outer sides 27, 27' of the core are connected by a wider, flatter central part 28. Since blowing conditions which are as constant as possible are required in a blow-moulding procedure, the lateral parts are designed in such a way that the additional height in the ski centre is compensated by the width defined by the waisting outside the mounting region. In this method, the raised lateral regions of the undercut are comoulded directly in the blow-moulding procedure.

Figure 9:
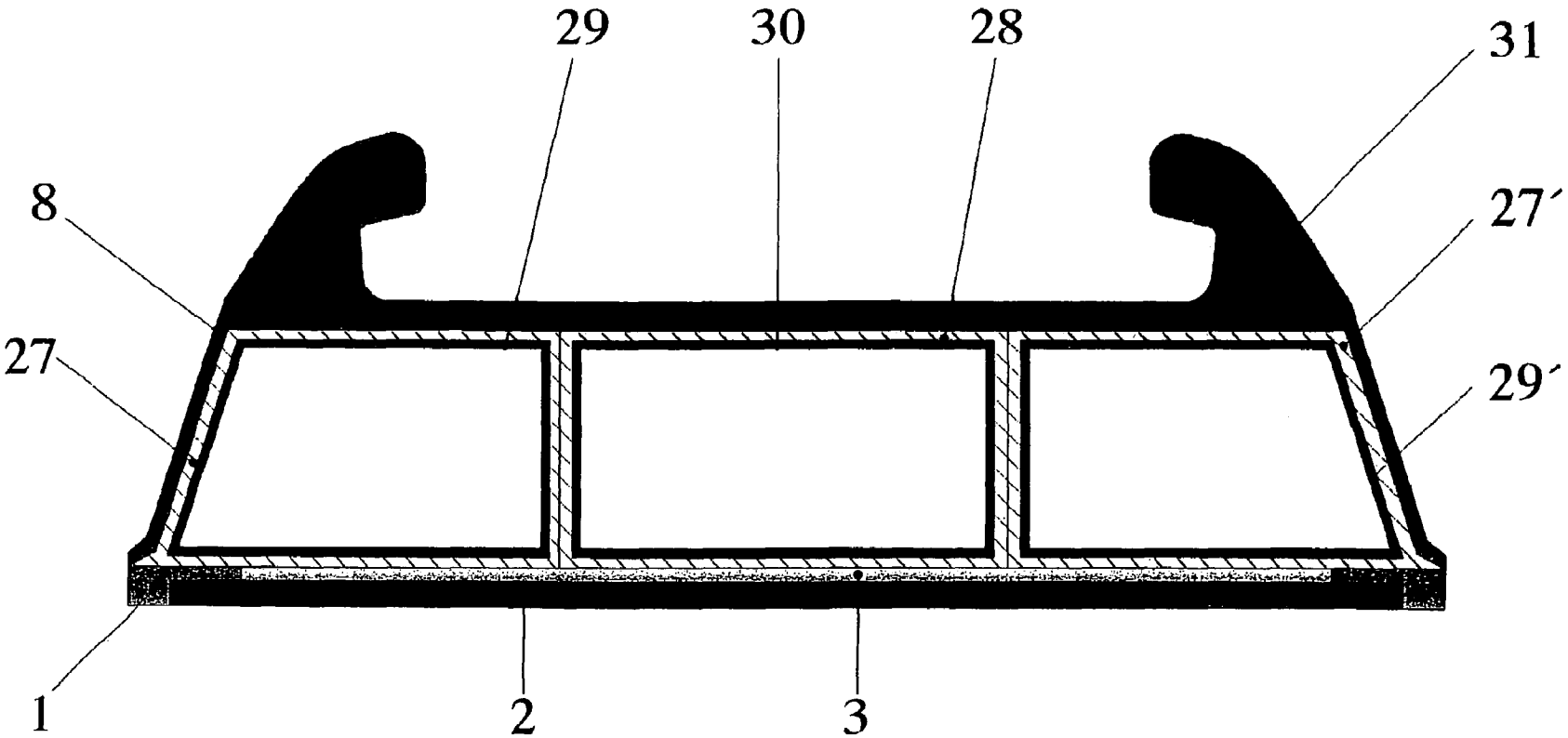
FIG. 9 shows an illustration corresponding to that according to FIG. 8, in which part of the ski basic body consists of a prefabricated profile.

FIG. 9 shows a ski cross section of a ski moulded using the blow-moulding method, in which the raised lateral regions are parts of a prefabricated profile 31 in the binding-receiving region.

The invention claimed is:

1. Sliding board, in particular alpine ski or snowboard, with a sliding-board basic body and a binding-receiving plate, characterized in that the binding-receiving plate is integrated as a supporting part in the central region of the sliding-board basic body, in which it is used, by being surrounded positively at the sides by integrally formed raised regions of the sliding-board basic body, said raised regions having oppositely disposed respective longitudinal slots with respective opposed openings adapted to receive the binding-receiving plate.

2. Sliding board according to claim 1, characterized in that thickness of the sliding-board basic body is correspondingly reduced in the central region of the sliding-board basic body, in which the binding-receiving plate is used.

3. Sliding board according to claim 1, characterized in that a deepened area, which ends in an open manner towards a sliding-board tip or towards a sliding-board end, is designed in the sliding-board basic body in the receiving region for the binding-receiving plate.

4. Sliding board according to claim 1, characterized in that a deepened area, which has a closed structure towards a sliding-board tip and/or towards a sliding-board end, is designed in the sliding-board basic body in the receiving region for the binding-receiving plate.

5. Sliding board according to claim 1, characterized in that the raised regions of the sliding-board basic body are formed from profiled strips.

6. Sliding board according to claim 1, characterized in that the raised regions have reinforcements in the contact region with the binding-receiving plate.

7. Sliding board according to claim 1, characterized in that the sliding-board basic body is manufactured using an injection method.

8. Sliding board according to claim 1, characterized in that the sliding-board basic body is manufactured using a blow-moulding method.

9. Sliding board according to claim 6 wherein the reinforcements are selected from the group consisting of glass fibers, profiles and wires.

10. A sliding board comprising a sliding-board basic body and a binding-receiving plate, wherein the binding-receiving plate has at least two oppositely disposed sides and is integrated as a supporting part in a central region of the sliding-board basic body by being surrounded positively at the oppositely disposed sides by integrally formed oppositely disposed raised regions of the sliding-board basic body, said raised regions having oppositely disposed respective longitudinal slots with respective opposed openings configured to receive the binding-receiving plate, wherein each respective raised region is monolithically incorporated into a respective side wall of the sliding board basic body.

11. A sliding board according to claim 10, wherein thickness of the sliding-board basic body is reduced in the central region of the sliding-board basic body which is adapted to receive the binding-receiving plate.

12. A sliding board according to claim 10, wherein a deepened area, which ends in an open maimer towards a sliding-board tip or towards a sliding-board end, is designed in the sliding-board basic body in the receiving region for the binding-receiving plate.

13. A sliding board according to claim 10, wherein a deepened area, which has a closed structure towards a sliding-board tip and/or towards a sliding-board end, is designed in the sliding-board basic body in the receiving region for the binding-receiving plate.

14. A sliding board according to claim 10, wherein the raised regions of the sliding-board basic body are formed from profiled strips.

15. A sliding board according to claim 10, wherein the raised regions have reinforcements in the contact region with the binding-receiving plate.

16. A sliding board according to claim 10, wherein the sliding-board basic body is manufactured using an injection method.

17. A sliding board according to claim 10, wherein the sliding-board basic body is manufactured using a blow-moulding method.

18. A sliding board according to claim 15 wherein the reinforcements are selected from the group consisting of glass fibers, profiles and wires.

19. A sliding board according to claim 10, wherein the sliding-board is a snowboard or a ski.

* * * * *